US007015659B2

(12) United States Patent
Yeh

(10) Patent No.: US 7,015,659 B2
(45) Date of Patent: Mar. 21, 2006

(54) APPARATUS FOR DRIVING A LIGHT TUBE AND METHOD THEREFOR

(75) Inventor: Chia-Tse Yeh, Jhongli (TW)

(73) Assignee: Benq Corporation, Taoyuan Shien (TW)

( * ) Notice: Subject to any disclaimer, the term of this patent is extended or adjusted under 35 U.S.C. 154(b) by 0 days.

(21) Appl. No.: 10/981,129

(22) Filed: Nov. 4, 2004

(65) Prior Publication Data

US 2005/0099132 A1 May 12, 2005

(30) Foreign Application Priority Data

Nov. 6, 2003 (TW) ..... 92131153 A

(51) Int. Cl.
*H05B 37/00* (2006.01)
*G09G 3/36* (2006.01)

(52) U.S. Cl. ..... 315/312; 345/102

(58) Field of Classification Search ..... 315/312, 315/224, 281, 282, 291, 304, 354; 345/29, 345/45, 102, 104

See application file for complete search history.

(56) References Cited

U.S. PATENT DOCUMENTS 6,025,824 A * 2/2000 Horiuchi et al. ..... 345/102
6,420,839 B1 * 7/2002 Chiang et al. ..... 315/311
6,534,934 B1 * 3/2003 Lin et al. ..... 315/312
6,750,842 B1 * 6/2004 Yu ..... 345/102
2003/0001524 A1 1/2003 Lin et al. ..... 315/312

FOREIGN PATENT DOCUMENTS

TW 360883 6/1999
TW 502928 9/2002

* cited by examiner

*Primary Examiner*—Shih-Chao Chen
*Assistant Examiner*—Minh Dieu A
(74) *Attorney, Agent, or Firm*—Thomas, Kayden, Horstemeyer & Risley, LLP

(57) ABSTRACT

An apparatus for driving a light tube and the method thereof. The driving apparatus includes a delay unit, a first logic device, a second logic device, and a transformer. The delay unit receives an input signal and a voltage control signal, and outputs a delay signal. The first logic device processes a first operation on the input signal and the voltage control signal, then outputs a first signal. The second logic device processes a logic operation on the input signal and the voltage control signal, and then outputs a second signal. The two ends of the primary coil of the transformer are respectively coupled to a first switch and a second switch which are respectively controlled by the first signal and the second signal. The secondary coil of the transformer outputs a driving signal to drive the light tube.

20 Claims, 4 Drawing Sheets

APPARATUS FOR DRIVING A LIGHT TUBE AND METHOD THEREFOR

This application claims the benefit of Taiwan application Ser. No. 92131153, filed Nov. 6, 2003, the subject matter of which is incorporated herein by reference.

BACKGROUND OF THE INVENTION

1. Field of the Invention

The invention relates in general to an apparatus for driving a light tube and the method thereof, and more particularly to an apparatus for driving a cold cathode florescent light (CCFL) tube and the method thereof.

2. Description of the Related Art

With the advantages of being small in size and light in weight, the liquid crystal display has become the mainstream product in display market. As the consumers are requesting a higher standard of display quality, high luminance and high contrast are two important factors when it comes to the selection of a display. A transparent liquid crystal display (LCD) uses a cold cathode fluorescent light (CCFL) tube as the backlight source. The CCFL tube is an important factor in determining the luminance and contrast parameters of a transparent LCD.

The CCFL driving circuit of a tube and the driving method have great influences on the luminance efficiency and lifespan of the CCFL tube. Referring to FIG. 1A, a conventional CCFL driving circuit is shown. The conventional CCFL driving circuit 100 includes NOR gates NO1~NO5, buffers 125 and 135, switches Q1 and Q2, a transformer T, capacitors C1~C3, and a resistor R for driving a CCFL tube 150.

Referring also to FIG. 1B, a timing diagram inside the driving circuit 100 is shown. The driving circuit 100 receives at the input end ip a squared wave S1 that has a fixed duty cycle and outputs a squared wave S2 that is delayed by the capacitor C1 and the resistor R for one delay period. NOR gates NO1 and NO2 perform a logic operation on squared waves S1 and S2 for outputting an operation value M1, which is the sum of S1 and S2, i.e., M1=S1+S2. NOR gates NO3 and NO4 perform a logic operation on squared waves S1 and S2 for outputting an operation value M2, which is the product of S1 and S2, i.e., M1=S1·S2. Operation values M1 and M2 control switches Q1 and Q2 via buffers 125 and 135, respectively. When operation value M2 is at a low level, the switch Q2 made of PMOS is switched on and the capacitor C2 is being charged. On the other hand, when operation value M2 is at a high level, the switch Q1 made of NMOS is switched on and the capacitor C2 is being discharged. By alternately switching Q1 and Q2 on and off, the primary voltage Vin of the transformer T is made a squared wave; by changing the duty cycle of the inputted squared wave S1, the duty cycle of the primary voltage Vin is changed responsively.

FIG. 1C is a diagram of the primary voltage and the secondary voltage of the driving circuit 100. Referring to FIG. 1A and FIG. 1C at the same time, the luminance of a light tube 150 is changed by changing the duty cycle of the primary voltage Vin. The secondary current Iout, which changes in response to the primary voltage, is of a sine wave due to the capacitor C3 and other stray capacitances. When the duty cycle of the primary voltage Vin becomes larger, the secondary current Iout thus becomes stronger, intensifying the luminance of the light tube 150 as shown in period T2. However, when the duty cycle of the primary voltage Vin is not 50%, the secondary current Iout is asymmetric, that is, the magnitudes of the positive peak value and the negative peak value are not the same. When the duty cycle of the primary voltage Vin is 50% as shown in period T1 and T3, the secondary current Iout is symmetric; When the duty cycle of the primary voltage is not 50% as shown in period T2, the secondary current Iout is asymmetric. When a current with poor symmetry is applied to the CCFL tube, an evenly distributed luminance of the tube cannot be achieved; moreover, the lifespan and the reliability of the tube are reduced.

SUMMARY OF THE INVENTION

It is therefore an object of the invention to provide an apparatus for driving a light tube and the method thereof to prolong the lifespan and to improve the luminance efficiency of the light tube.

It is another object of the invention to provide an apparatus for driving a light tube, wherein the driving apparatus includes a first input end, a second input end, a delay unit, a first logic device, a second logic device, and a transformer. The first input end receives an input signal. The second input end receives a voltage control signal. The delay unit receives the input signal and the voltage control signal for outputting a delay signal, wherein the delay signal is the input signal delayed for a time period determined by the voltage control signal. The first logic device receives and performs a logical first operation based on the input signal and the voltage control signal, then outputs a first signal. The second logic device receives and performs a logical second operation based on the input signal and the voltage control signal, then outputs a second signal. The transformer includes a primary coil, a secondary coil, a first switch, and a second switch. The two ends of the primary coil of the transformer are respectively coupled to the first switch and the second switch, which are respectively controlled by the first signal and the second signal. The secondary coil of the transformer outputs a driving signal induced by the primary coil to drive the light tube.

It is another object of the invention to provide a method for driving a light tube. The method includes the steps of receiving an input signal and a voltage control signal; outputting a delay signal, wherein the delay signal is the input signal delayed for a time period determined by the voltage control signal; receiving the input signal and the delay signal and performing a first operation based on the input signal and the delay signal, then outputting a first signal; receiving the input signal and the delay signal and performing a second operation on the input signal and the delay signal, then outputting a second signal; and driving the light tube in response to the first signal and the second signal.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1A:
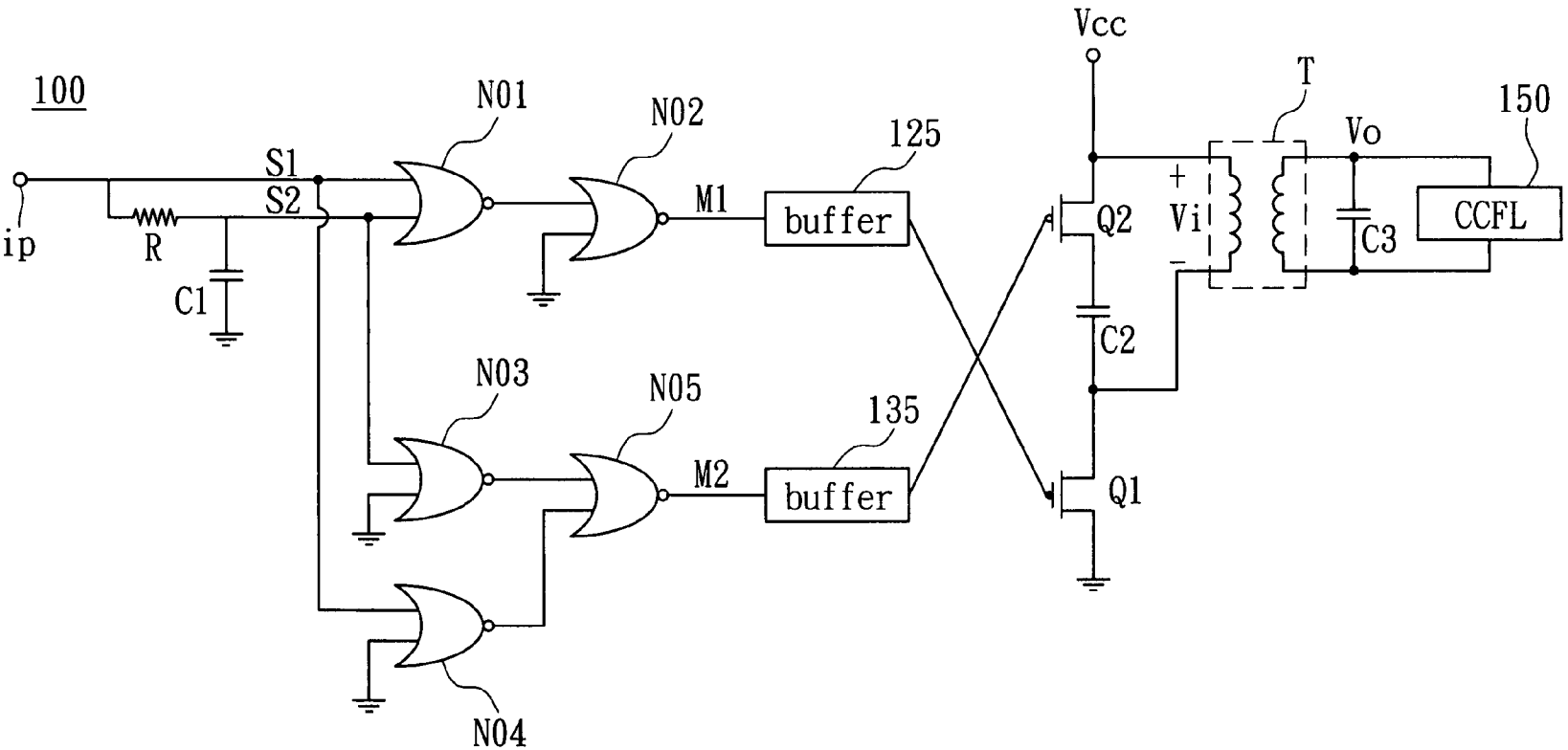
FIG. 1A(PRIOR ART)
FIG. 1A (prior art) is a conventional driving circuit of a CCFL tube.
Figure 1B:
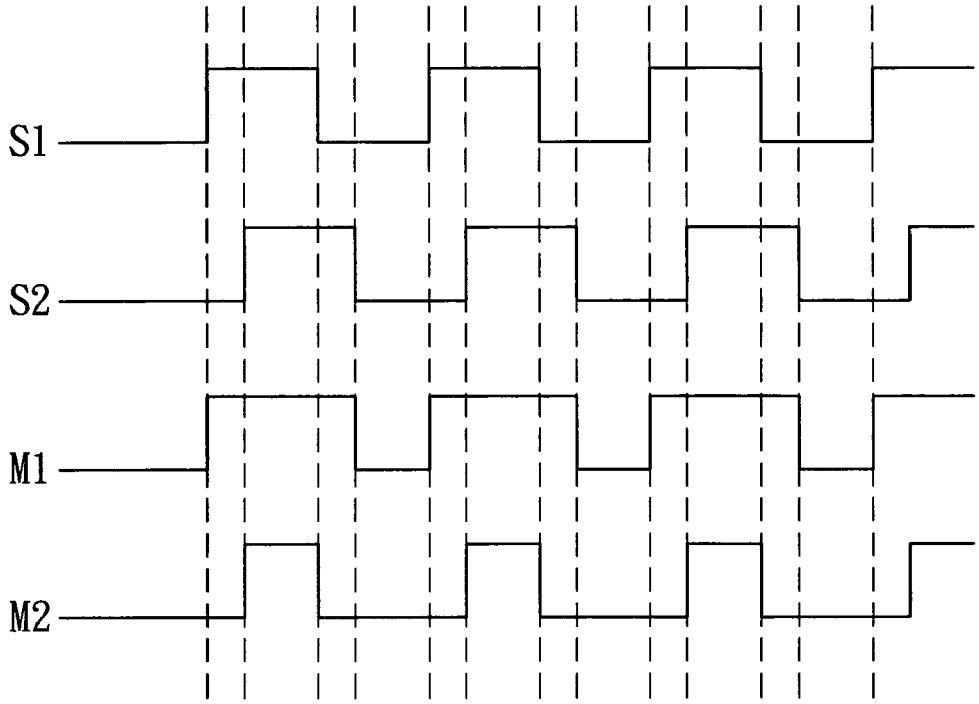
FIG. 1B(PRIOR ART)
FIG. 1B (prior art) is a timing diagram of a driving circuit 100.
Figure 1C:
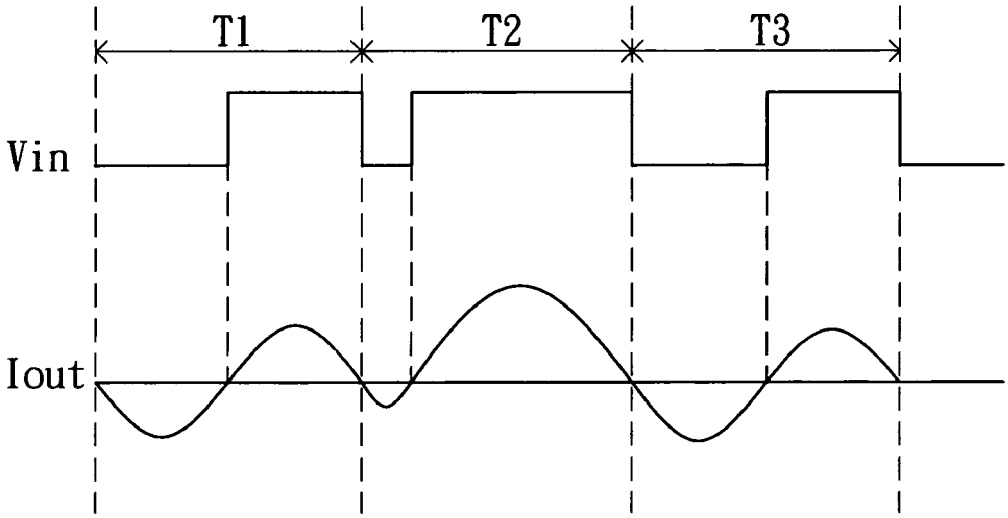
FIG. 1C(PRIOR ART)
FIG. 1C (prior art) is a diagram of a primary voltage and a secondary voltage of the driving circuit 100.
Figure 2A:
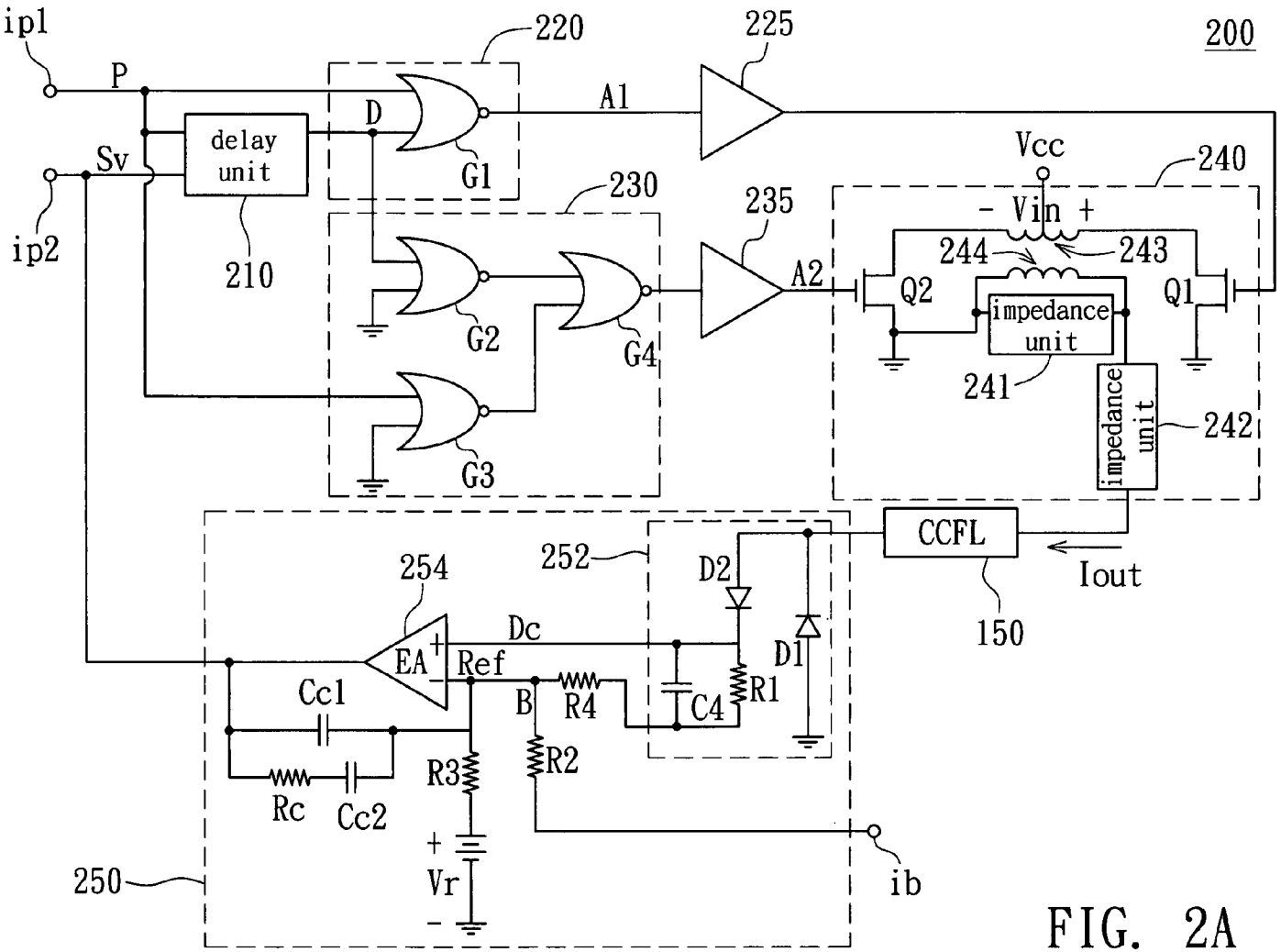
FIG. 2A is an apparatus for driving a light tube according to a preferred embodiment of the invention.

Referring to FIG. 2A, an apparatus for driving a CCFL light tube according to a preferred embodiment of the invention is shown. A driving apparatus 200 includes a first input end ip1, a second input end ip2, a delay unit 210, a first logic device 220, a second logic device 230, and a transformer 240. The first input end ip1 receives a squared wave input signal P whose duty cycle is 50%, while the second input end ip2 receives a voltage control signal Sv. The delay unit 210, which is coupled to both the first input end ip1 and the second input end ip2, receives the input signal P and the voltage control signal Sv for outputting a delay signal D that is the input signal P delayed for a time period t determined according to the voltage control signal Sv.

The first logic device 220 receives and performs a first operation on the input signal P and the delay signal D, then outputs a first signal A1. The second logic device 230 receives and performs a second operation on the input signal P and the delay signal D, then outputs a second signal A2. The first operation performed by the first logic device 220 is a NOR operation, i.e., A1=(P+D)' and the second operation performed by the second logic device 230 is an AND operation, i.e., A2=P·D. The first signal A1 and the second signal A2 may be respectively amplified and stabilized by the buffer 225 and the buffer 235.

The transformer 240 is a push-pull transformer including a primary coil 243, a secondary coil 244, a first switch Q1, and a second switch Q2. The middle point of the primary coil 243 is coupled to a power source Vcc, and the two ends of the primary coil 243 are respectively coupled to the first switch Q1 and the second switch 02. The first switch Q1 and the second switch Q2 are respectively controlled by the first signal A1 and the second signal A2. The secondary coil 244 outputs a secondary current Iout according to the voltage of the primary coil 243 to drive a light tube 150.

The driving apparatus 200 further includes a feedback unit 250 that generates and feeds back a voltage control signal Sv to the delay unit 210 by way of a closed loop to further stabilizes the luminance of the light tube.

The feedback unit 250 includes a rectifier 252 and an error amplifier (EA) 254. The rectifier 252 rectifies the secondary current Iout, then outputs a direct current signal Sd. The error amplifier 254 has a non-inverting input end and an inverting input end for respectively receiving the direct current signal Sd and a reference signal Ref to output the voltage control signal Sv to the delay unit 210. The rectifier 252 includes diodes D1 and D2, a resistor R1, and a capacitor C4. The reference signal Ref is provided by the voltage source Vr via the resistor R3. Capacitors Cc1 and Cc2, and a resistor Rc are for stabilizing the output value of the error amplifier 254.

The feedback unit 250 further includes an input end ib for receiving a luminance control signal B, wherein the luminance control signal B is inputted to the inverting input end of the error amplifier 254 via the resistor R2. The error amplifier 254 outputs the voltage control signal Sv according to the direct current signal Sd, the reference signal Ref, and the luminance control signal B.

Figure 2B:
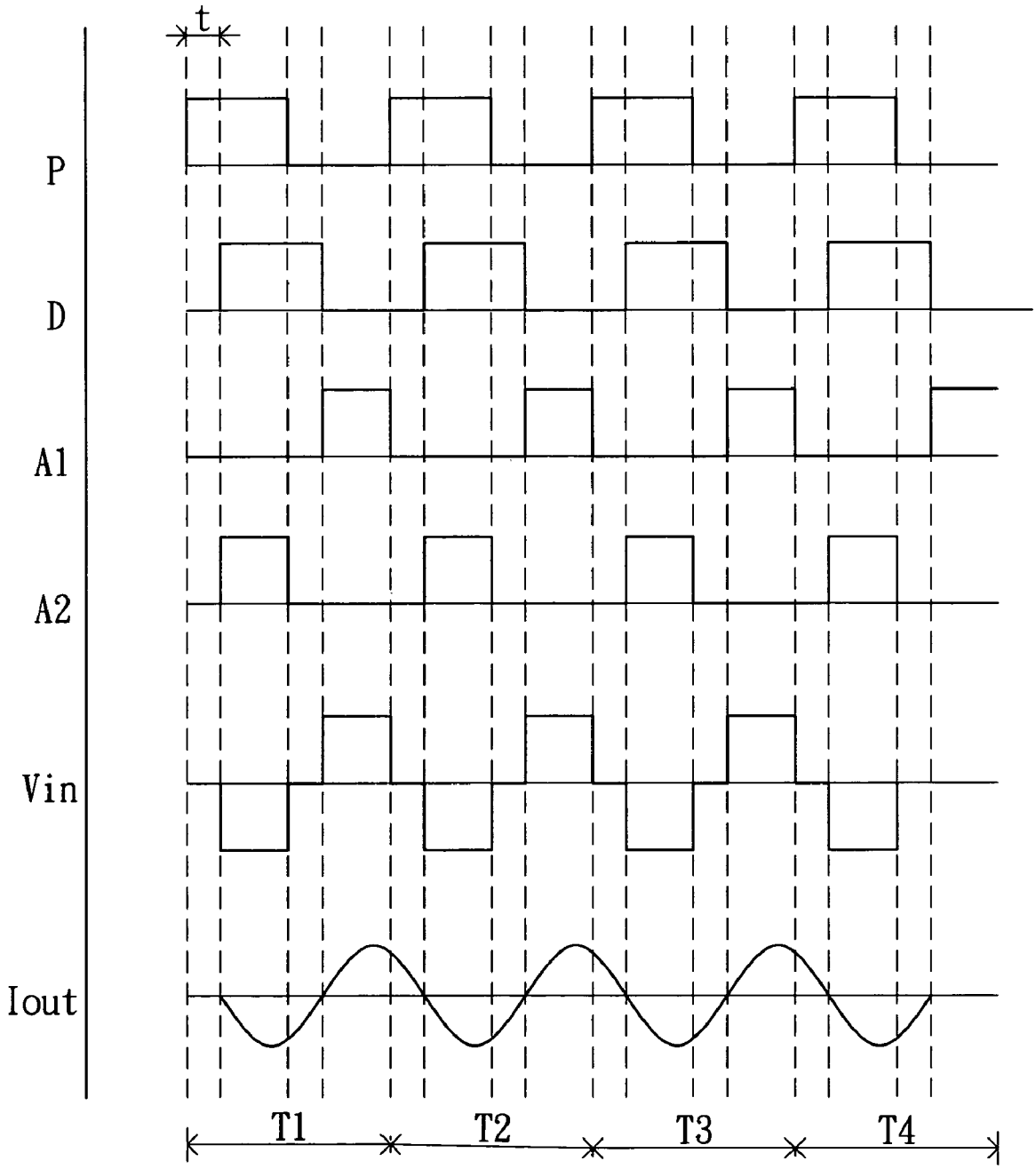
FIG. 2B is a timing diagram of the driving apparatus 200.

FIG. 2B is a timing diagram of a driving apparatus 200. The duty cycle of the input signal P is 50% with a period T. The delay signal D is the input signal P delayed for a time period t. The first signal A1 is the value of a NOR operation performed on the input signal P and the delay signal D. The second signal A2 is the value of an AND operation performed on the input signal P and the delay signal D. When the first switch Q1, which is controlled by the first signal A1, is conducted, the value of the primary voltage Vin is positive. When the second switch Q2, which is controlled by the second signal A2, is conducted, the value of the primary voltage Vin is negative. The value of the secondary current Iout is determined according to the primary voltage Vin. Due to stray capacitances and an impedance unit 241, the secondary current Iout is a sine wave.

It is noteworthy that the duration of the primary voltage Vin being positive is the same as the duration of the primary voltage Vin being negative in every cycle. That is, the duration of the primary voltage Vin being positive, T/2-t, is also the duration of the primary voltage Vin being negative in every cycle. The larger the time period t is, the shorter the duration of the primary voltage Vin being positive or negative in a cycle are and the smaller the value of the secondary current Iout is, so as to decrease the luminance of the light tube. On the other hand, the smaller the time period t is, the longer the duration of the primary voltage Vin being positive or negative in a cycle are and the larger the value of the secondary current Iout is, so as to intensify the luminance of the light tube. So, by changing the time period t, the luminance of a light tube may be adjusted accordingly. When the secondary current Iout is symmetric in every cycle, the luminance of a light tube is evenly distributed; this not only prolongs the lifespan, but also improves the reliability of the light tube.

The driving apparatus of a light tube disclosed in the above preferred embodiment of the invention maintains the symmetry of the current of the light tube to achieve an evenly distributed luminance and to further prolong the lifespan of the light tube. The invention further stabilizes the luminance of the light tube with a feedback loop and controls the luminance intensity by inputting an external luminance control signal.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A driving apparatus for driving a light tube, wherein the driving apparatus comprises:

a first input end, which receives an input signal;

a second input end, which receives a voltage control signal;

a delay unit, which outputs a delay signal based on the input signal and the voltage control signal received by the delay unit, wherein the delay signal is the input signal delayed by a time period determined by the voltage control signal;

a first logic device, which performs a first operation based on the input signal and the delay signal received by the first logic device, and outputs a first signal;

a second logic device, which performs a second operation based on the input signal and the delay signal received by the second logic device, and outputs a second signal; and a transformer, which comprises a primary coil, a secondary coil, a first switch, and a second switch, wherein the two ends of the primary coil of the transformer are respectively coupled to the first switch and the second switch, which are respectively controlled by the first signal and the second signal, the secondary coil outputs a driving signal induced by the primary coil to drive the light tube.

2. The driving apparatus according to claim 1, wherein the input signal is a squared wave and the voltage control signal is a direct current signal.

3. The driving apparatus according to claim 2, wherein the duty cycle of the input signal is fixed.

4. The driving apparatus according to claim 1, wherein the first operation is a NOR operation.

5. The driving apparatus according to claim 1, wherein the second operation is an AND operation.

6. The driving apparatus according to claim 1, wherein the delay unit is a voltage-controlled delay unit.

7. The driving apparatus according to claim 1, wherein the transformer is a push-pull transformer.

8. The driving apparatus according to claim 1, wherein the driving apparatus further comprises a feedback unit, comprising:

a rectifier, which rectifies the driving signal and outputs a direct current signal; and an error amplifier, which has a third input end and a fourth input end for receiving the direct current signal and a reference signal, respectively, and outputs the voltage control signal to the delay unit based on the direct current signal and the reference signal.

9. The driving apparatus according to claim 8, wherein the error amplifier further receives a luminance control signal at the fourth input end and outputs the voltage control signal based on the direct current signal, the reference signal, and the luminance control signal.

10. The driving apparatus according to claim 1, further comprising a first buffer connected to the output of the first logic device for buffering the first signal that controls the first switch.

11. The driving apparatus according to claim 1, further comprising a second buffer connected to the output of the second logic device for buffering the second signal that controls the second switch.

12. A driving method for driving a light tube, comprising the steps of:

receiving an input signal;

receiving a voltage control signal;

outputting a delay signal, wherein the delay signal is the input signal delayed by a time period determined by the voltage control signal;

receiving the input signal and the delay signal and performing a first operation based on the input signal and the delay signal;

outputting a first signal;

receiving the input signal and the delay signal and performing a second operation based on the input signal and the delay signal;

outputting a second signal; and driving the light tube in response to the first signal and the second signal.

13. The driving method according to claim 12, further comprising a step of outputting a driving signal for driving the light tube in response to the first signal and the second signal.

14. The driving method according to claim 12, wherein the input signal is a squared wave and the voltage control signal is a direct current signal.

15. The driving method according to claim 14, wherein the duty cycle of the input signal is fixed.

16. The driving apparatus according to claim 12, wherein the first operation is a NOR operation.

17. The driving apparatus according to claim 12, wherein the second operation is an AND operation.

18. The driving method according to claim 12, further comprising a step of feeding back a driving signal to generate the voltage control signal.

19. The driving method according to claim 18, wherein the step of feeding back the driving signal comprises steps of:

rectifying the driving signal and outputting a direct current signal; and comparing the direct current signal with a reference signal to generate the voltage control signal.

20. The driving method according to claim 19, wherein the step of feeding back the driving signal further comprises receiving a luminance control signal and comparing the luminance control signal with the direct current signal and the reference signal to generate the voltage control signal.

* * * * *